US005094192A

United States Patent [19]

Seiffert et al.

[11] Patent Number: 5,094,192

[45] Date of Patent: Mar. 10, 1992

[54] SAFETY ARRANGEMENT FOR AN INTERNAL COMBUSTION ENGINE

[75] Inventors: Ulrich Seiffert, Braunschweig; Hans-Peter Jaekel, Frellstedt, both of Fed. Rep. of Germany

[73] Assignee: Volkswagen AG, Wolfsburg, Fed. Rep. of Germany

[21] Appl. No.: 704,798

[22] Filed: May 23, 1991

[30] Foreign Application Priority Data

May 30, 1990 [DE] Fed. Rep. of Germany ..... 4017386

[51] Int. Cl.[5] ..... F01P 5/14

[52] U.S. Cl. ..... 123/41.15; 123/198 DB

[58] Field of Search ..... 123/41.15, 41.44, 198 DB

[56] References Cited

U.S. PATENT DOCUMENTS 3,590,798 7/1971 Goodwin ..... 123/41.15
3,817,224 6/1974 Pluequet et al. ..... 123/41.15
3,958,548 5/1976 Koci et al. ..... 123/41.15
4,459,951 7/1984 Tobinaga et al. ..... 123/41.15
4,473,045 9/1984 Bolander et al. ..... 123/41.15

FOREIGN PATENT DOCUMENTS 967248 10/1957 Fed. Rep. of Germany .

*Primary Examiner*—Noah P. Kamen
*Attorney, Agent, or Firm*—Brumbaugh, Graves, Donohue & Raymond

[57] ABSTRACT

A safety arrangement is provided to protect an internal combustion engine from excessive temperatures in case of an abnormality in its circulating cooling system. In response to failure of an electrical coolant pump, the safety arrangement generates signals for retarding the ignition and/or reducing the fuel injection and/or limiting the charge so as to limit the load and/or the speed of the internal combustion engine.

1 Claim, 1 Drawing Sheet

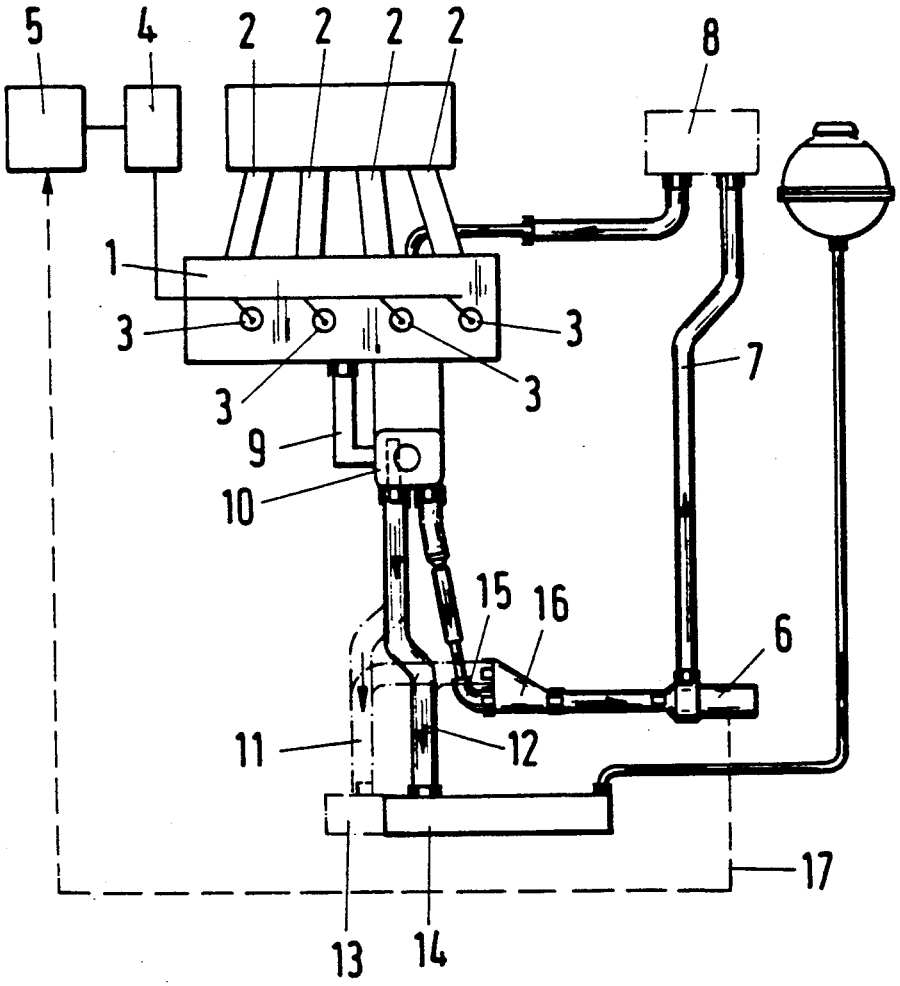
5
4
2
2
2
2
8
1
3
3
3
3
7
9
10
15
16
6
11
12
17
13
14

SAFETY ARRANGEMENT FOR AN INTERNAL COMBUSTION ENGINE

BACKGROUND OF THE INVENTION

This invention relates to safety arrangements for internal combustion engines having a circulating coolant.

Safety arrangements for internal combustion engines which are arranged to prevent damage to the engine resulting from overheating are relatively old. One device of this type is described in German Patent No. 967 248. In that safety device, a thermostat detects the engine temperature and responds to overheating by controlling the maximum throttle deflection through a mechanical connection. After a selected engine temperature has been reached, the thermostat limits the deflection of the throttle and thus reduces the fuel supply.

However, rapid actuation of the limitation of the load and/or the speed of the internal combustion engine is required when an abnormality in the cooling system occurs. This is especially true in evaporative cooling systems where cooling of the engine is provided not only by convection but also by a change of the state of the coolant. The use of such evaporative systems for the cooling of engines of motor vehicles is increasing and in such systems the conventional safety device described above is not suitable.

SUMMARY OF THE INVENTION

Accordingly, it is an object of the present invention to provide a safety device for an internal combustion engine having a circulating coolant which overcomes the above-mentioned disadvantages of the prior art.

Another object of the invention is to provide a safety device arranged to provide a rapid response which limits the load and/or the speed of the engine, regardless of any thermal inertia in the cooling system.

These and other objects of the invention are attained by providing a device for monitoring the operation of the coolant pump and limiting an operating parameter of the engine in response to coolant pump failure.

The invention is based on the fact that the most common cause of failure of the cooling system is a breakdown of the electrical coolant pump and that the cooling effect of the cooling system is essentially dependent on the faultless operation of the coolant pump which provides liquid coolant to the internal combustion engine. With evaporative cooling, the coolant pump must at least replace the liquid which evaporates in the cooling chambers of the internal combustion engine. It also must assure a sufficient flow of the liquid coolant to remove the coolant which has vaporized in the engine. Finally, proper operation of the coolant pump is also essential for heating of the vehicle equipped with the engine, since the waste heat of the internal combustion engine must be carried to the vehicle heater by the coolant.

If the electrical coolant pump fails, the internal combustion engine overheats in a relative short period of time under full load conditions, which may cause, for example, a destructive seizing of the pistons.

Because the invention responds to the cause of overheating by detecting failure of the coolant pump rather than the effect of overheating indicated, for example, by increased coolant temperatures or increased coolant pressure, the operational condition of the internal combustion engine is very rapidly controlled in the sense of a reduction of the load and/or the engine speed. This, in turn, provides the advantageous possibility of reducing the load or the speed of the internal combustion engine to a limited degree without danger of damage because of excessive temperatures. Consequently, it is not necessary, for example, to immediately turn the engine off, which could lead to dangerous traffic situations.

BRIEF DESCRIPTION OF THE DRAWING

Further objects and advantages of the invention will be apparent from a reading of the following description in conjunction with the accompanying drawing which illustrates schematically a representative internal combustion engine having an evaporative cooling system arranged in accordance with the invention.

DESCRIPTION OF PREFERRED EMBODIMENTS

In the typical embodiment shown in the drawing, a cylinder head 1 for an internal combustion engine receives air which is supplied in the conventional manner through four intake pipes 2, in the case of a four-cylinder engine. Assuming that the engine is a fuel-injected internal combustion engine with spark ignition, four spark plugs 3 are provided along with a distributor. The spark plugs are supplied with ignition signals in accordance with an electronic control device 5.

In the coolant system, an electrical coolant pump 6 circulates a supply of liquid coolant through a line 7 to the regions of the internal combustion engine which are to be cooled, including the cylinder head 1. A heat exchanger 8 for a vehicle heating system is included in the conventional manner in the line 7. The direction of flow of the coolant in the coolant circulating lines is indicated by arrows. The coolant provides for the cooling of regions within the internal combustion engine through both convection and evaporation, so that vaporized coolant leaves the engine through a line 9. After passing through a liquid-vapor separator 10, the coolant vapor flows through two lines 11 and 12 to two condensers 13 and 14, from which the coolant is drawn through a duct arrangement 15 by the coolant pump 6 for circulation to the engine through the line 7. After condensation in the condensers 13 and 14, the liquid coolant is mixed in a combining unit 16, placed upstream from the pump 6, with the liquid coolant coming from the separating device 10.

The cooling system as thus far described is a conventional arrangement.

As shown by the foregoing description of the illustrated cooling system, flawless operation of the coolant pump 6 is essential to the functioning of the entire cooling system. Failure of the pump 6 will result in dangerous overheating of the internal combustion engine. For this reason, the invention provides an arrangement for detecting electrically any breakdown of the coolant pump 6 and for controlling engine operating parameters by causing a reduction of the load and/or speed of the engine. A breakdown of the operation of the coolant pump can be detected, for example, by means of a loss of current or excessively high current in the power supply to the drive motor for the pump 6. In such case, an appropriate signal, as indicated by the dash line 17 in the drawing, is supplied to the control device 5 for the internal combustion engine control system, which then supplies appropriate control signals for power reduction to the ignition device such as for retarding of the ignition point. Alternatively, if desired, the control device 5 may be arranged to generate a signal to reduce the quantity of injected fuel or to reduce the charge supplied to the combustion chambers of the engine.

It will be understood that the invention can also be used in connection with a diesel engine.

As the description of an exemplary embodiment also shows, the invention provides the advantageous opportunity for very rapid detection of an abnormality in the cooling system of an internal combustion engine, even prior to any change in the temperature of the coolant.

Although the invention has been described herein with reference to specific embodiments, many modifications and variations therein will readily occur to those skilled in the art. Accordingly, all such variations and modifications are included within the intended scope of the invention.

We claim:

1. An arrangement for protecting an internal combustion engine which is cooled by a circulating coolant comprising a coolant pump for circulating coolant through the engine, an electric power supply for the coolant pump, control means for limiting at least one of the load and the speed of the engine by controlling at least one of the ignition time, the amount of fuel supplied and the charge, and means for detecting abnormal values of the electric current in the power supply for the coolant pump resulting from a failure of the coolant pump and for initiating a control action by the control means.

* * * * *